US009021920B2

(12) United States Patent
Singh Sidhu

(10) Patent No.: US 9,021,920 B2
(45) Date of Patent: May 5, 2015

(54) GEARED CLICKLESS SOCKET WRENCH

(71) Applicant: Dalwinder Singh Sidhu, Allenhurst, NJ (US)

(72) Inventor: Dalwinder Singh Sidhu, Allenhurst, NJ (US)

( * ) Notice: Subject to any disclaimer, the term of this patent is extended or adjusted under 35 U.S.C. 154(b) by 277 days.

(21) Appl. No.: 13/738,218

(22) Filed: Jan. 10, 2013

(65) Prior Publication Data

US 2014/0013903 A1 Jan. 16, 2014

Related U.S. Application Data

(63) Continuation-in-part of application No. 12/786,847, filed on May 25, 2010, now abandoned.

(51) Int. Cl.
*B25B 17/00* (2006.01)
*B25B 13/46* (2006.01)

(52) U.S. Cl.
CPC ..... *B25B 17/00* (2013.01); *B25B 13/463* (2013.01)

(58) Field of Classification Search
USPC ..... 81/57.3, 57.14, 58.1, 58.4, 60, 63.1
See application file for complete search history.

(56) References Cited

U.S. PATENT DOCUMENTS

| | | | | |
|---|---|---|---|---|
| 3,867,855 | A * | 2/1975 | Siebert | 81/63.1 |
| 8,375,830 | B1 * | 2/2013 | Yang | 81/60 |
| 2013/0276593 | A1 * | 10/2013 | Yang | 81/60 |

* cited by examiner

*Primary Examiner* — Hadi Shakeri
(74) *Attorney, Agent, or Firm* — Gertner Mandel & Peslak; Arthur M. Peslak

(57) ABSTRACT

A geared socket wrench hand tool is disclosed. The socket wrench is a clickless wrench allowing for more precise movement of the socket. The socket wrench, through a series of gears, can rotate in infinitesimally small rotations.

1 Claim, 3 Drawing Sheets

GEARED CLICKLESS SOCKET WRENCH

PRIORITY CLAIM

This application claims priority to and is a continuation-in-part of co-pending U.S. application Ser. No. 12/786,847 filed May 25, 2010.

BACKGROUND OF THE INVENTION

The present invention is directed to the field of hand tools. In particular, the present invention is directed to a new socket wrench used for tightening and loosening bolts and nuts.

The available socket wrenches are provided with a driver for a socket extending perpendicular from a front surface of the wrench. The socket is adapted to engage the head of a bolt or nut in order to tighten or loosen the bolt or nut. The wrench generally operates by rotating the wrench handle in a clockwise or counterclockwise direction to either tighten or loosen the bolt or nut. The rotation of the wrench handle is translated into a fixed circular movement of the socket. Normally, the mechanism in the wrench handle causes an audible click. Thus, for each click of the mechanism the socket rotates a fixed amount. In certain circumstances, more precise rotation is required.

The primary object of the present invention is to solve the problem where a socket wrench must rotate a precise amount for each movement of the handle. The present invention solves this problem by providing a clickless socket wrench that is capable of continuous rotation in any desired incremental steps.

SUMMARY OF INVENTION

A geared rotating socket wrench capable of infinitesimally small incremental rotations, comprising a handle with a proximal end, a distal end, a front surface and a rear surface; a rotating driver head disposed perpendicular to the front surface of the distal end wherein a socket can be disposed thereon and the rotating driver can rotate in a clockwise or counterclockwise direction; a lever mounted on the rear surface of the handle near the distal end thereof for selecting clockwise or counterclockwise direction of the rotating driver head; a first rotating gear with a plurality of teeth disposed on its perimeter connected by a first shaft to the rotating driver head; a second rotating gear with a plurality of teeth disposed on its perimeter mounted to a second shaft on the handle wherein the teeth on the first gear rotatingly mate with the teeth on the second gear; two third gears fixed to the handle mounted laterally to the second rotating gear wherein the third gears engage the second gear if the user attempts to rotate the socket in a direction not selected and thereby preventing the driver head from rotating in a direction not selected by the lever.

DETAILED DESCRIPTION OF THE INVENTION

Figure 1:
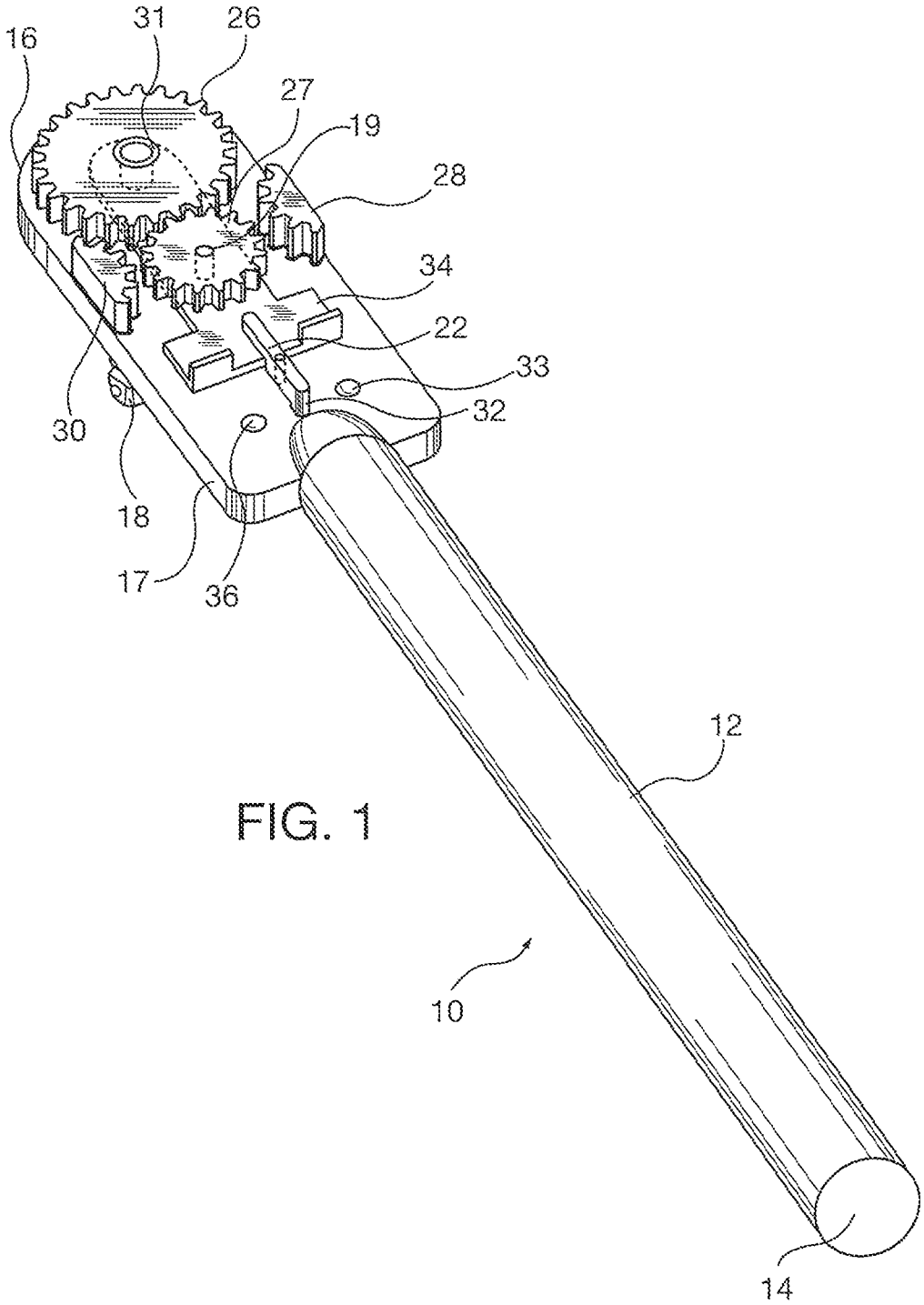
FIG. 1 is a cut-away plan view of an embodiment of the present invention.
Figure 3:
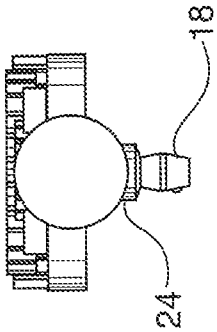
FIG. 3 is a rear view of an embodiment of the present invention.
Figure 2:
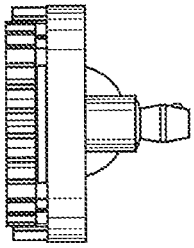
FIG. 2 is a front view of an embodiment of the present invention.
Figure 4:
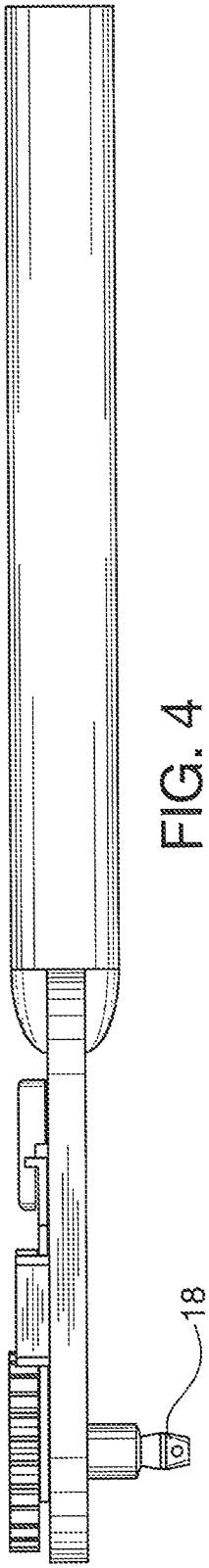
FIG. 4 is a side view of an embodiment of the present invention.
Figure 5:
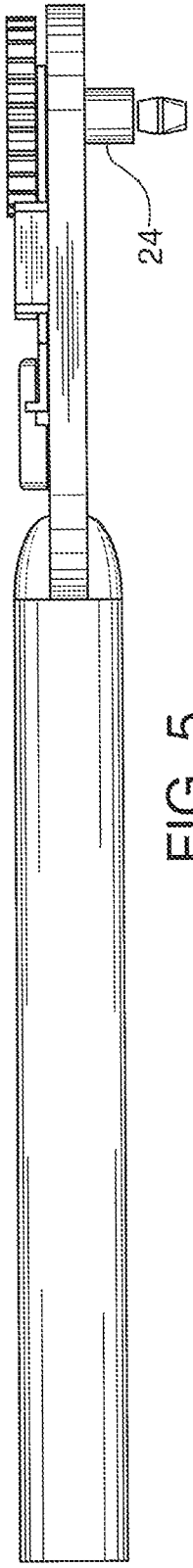
FIG. 5 is a side view of an embodiment of the present invention.

The present invention will now be described in terms of the presently preferred embodiment thereof as illustrated in the appended drawings. This description should not be construed as limiting the scope of the appended claims.

The geared socket wrench 10 of the present invention is illustrated in the drawings. The wrench 10 comprises a handle 12 with a proximal end 14 and a distal end 16. A user will grip the proximal end 14. The distal end 16 comprises a plate 17 with a rotating driver head 18 perpendicular to the distal end 16 and adapted to engage a socket 20 or other similar device.

A lever 22 is disposed on the exterior surface of the handle 12 near the distal end 16 and opposite to the driver head 18. The lever 22 rotates from left to right and engages through hole 33 or 36 in plate 17. As explained below, the lever 22 is adapted to change the direction of rotation of the driver head 18 between a clockwise direction and a counterclockwise direction.

The cutaway view of the socket wrench 10 shown in FIG. 1 illustrates the internal mechanism of the socket wrench 10. As shown in FIG. 1, a rotating shaft 24 is mounted between the driver head 18 and a first rotating gear 26 with a plurality of teeth disposed on its perimeter. A second rotating gear 27, with a plurality of teeth disposed on its perimeter, is mounted on a shaft 19 to plate 34 and engages the first rotating gear 26. Disposed on either side of the second rotating gear 27 is a first small gear 28, with a plurality of teeth disposed on its perimeter, and a second small gear 30, with a plurality of teeth disposed on its perimeter. Both the first small gear 28 and the second small gear 30 are fixed in position and do not rotate. The first small gear 28 and the second small gear 30 can be rigidly attached to plate 17 or integrally formed as one piece with the plate 17. As explained further below, the purpose of the first small gear 28 and the second small gear 30 is to act as a stop to prevent rotation of the first rotating gear 26 in the wrong direction.

The operation of the socket wrench 10 is illustrated further in the Figures. As shown therein, a socket 20 is attached to the driver head 18 as in a conventional available socket wrench. The user will engage a bolthead and rotate the wrench 10 in the desired direction to either loosen or tighten the bolthead as required. The lever 22 is connected to a second plate 34. The second plate 34 can pivot about the drag ring 31 which is attached to plate 17. By moving the lever 22 from one side to the other, the user can select the proper direction of rotation of the driver head 18. The lever 22 engages the second rotating gear 27 which in turn rotates the first gear 26 in the appropriate direction. If the user attempts to rotate the socket in the wrong direction, the second gear 27 will engage either the first or second small gear 28 or 30. Since the small gears are fixed and do not rotate, the second gear 27 and consequently the first gear 26 will be prevented from rotating in the unintended direction when it engages one of the smaller gears as explained further below. Further, the driver head 18 is capable of rotation in infinitesimally small increments as opposed to existing socket wrenches which rotate a fixed amount for each click of the wrench.

Figure 6:
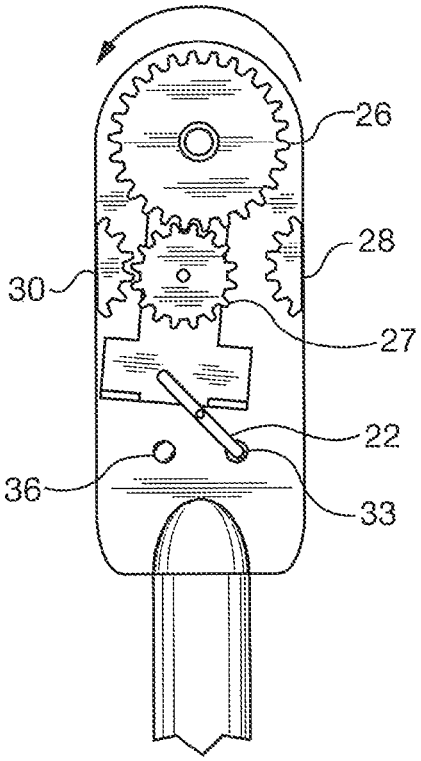
FIG. 6 is a cut-away side view of an embodiment of the present invention.
Figure 7:
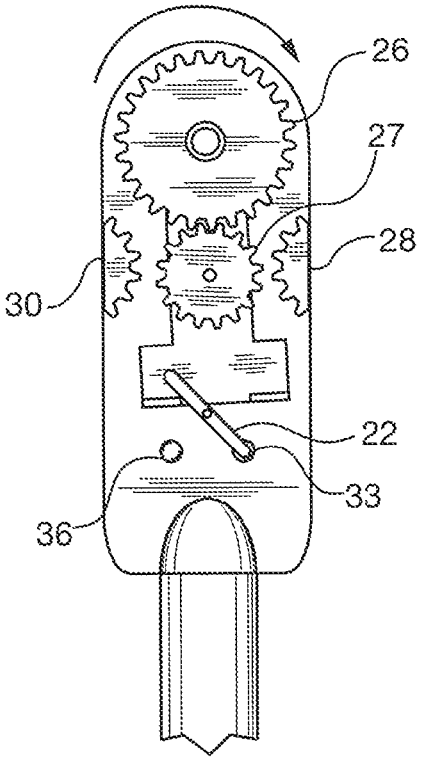
FIG. 7 is a cut-away side view of an embodiment of the present invention.

In FIG. 6, the lever 22 engages through hole 33 which selects counter clockwise rotation for the socket 18. The drag ring 31 holds plate 34 in the same position as handle 12. As a result, plate 34 moves to the left and lever 22 does not stop the plate 34 from moving to that side. As shown in FIG. 6, gear 27 engages with gear 30 and is locked. Gear 27 is always engaged with gear 26, and locks drag ring 31 and moves the socket 18 in the direction of the handle 12, i.e. counter clockwise. In this position, the ratchet is locked. In the reverse stroke when handle 12 moves back, the direction of rotation of the handle 12 is clockwise. In this case, lever 22 is selected to the side so as not to hinder the movement of plate 34 towards the left. In the reverse stroke, plate 34 tries to move towards the right but lever 22 stops in the middle and the gear 27 spins free. When the handle 12 moves again in the reverse direction, that is counter clockwise, gear 27 moves and engages with gear 30 and is locked. Thereby drag ring 31 moves along with the handle 12. In the reverse stroke, plate 34 cannot be locked and will spin free and the socket 18 will not rotate. As the handle 12 moves, drag ring 31 moves counter clockwise. As the drag ring 31 is attached to the socket 18, the handle 12 spins free as shown in FIGS. 6 and 7.

Figure 8:
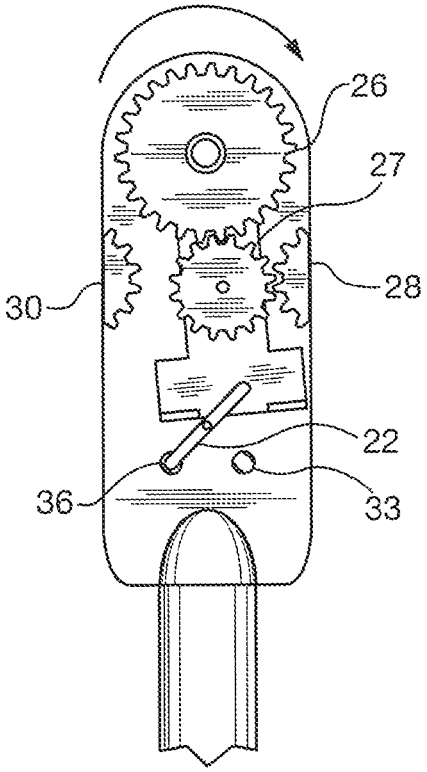
FIG. 8 is a cut-away side view of an embodiment of the present invention.
Figure 9:
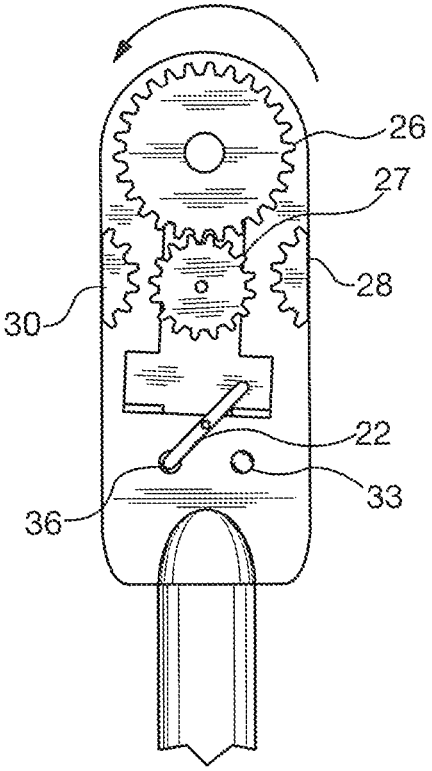
FIG. 9 is a cut-away side view of an embodiment of the present invention.

The lever 22 is selected for clockwise rotation of the socket 18 and engages through hole 36, in FIG. 8 and FIG. 9. When the handle 12 moves clockwise the plate 34 moves towards the right side engaging with gear 28 and is locked. Since gear 26 is always engaged with gear 27, both get locked and move with the handle 12. Thus turning the socket 18 in the required clockwise direction. When the handle 12 moves in the reverse direction, counter clockwise, plate 34 tries to move left but it cannot move towards complete left but rests in the center and cannot engage with any part, and moves freely and the socket 18 does not rotate. When the direction of the handle 12 is reversed again, the plate 34 engages with gear 28 and gets locked and thereby gear 26 is also locked and moves with the handle 12. Thus the socket 18 moves clockwise and in the other direction, the handle 12 spins free. Those of ordinary skill in the art will recognize that the foregoing merely represents an embodiment of the present invention. Many obvious modifications may be made thereto without departing from the spirit or scope of the present invention as set forth in the applied application.

What is claimed is:

1. A geared rotating socket wrench capable of infinitesimally small incremental rotations, comprising:

a handle with a proximal end, a distal end, a front surface and a rear surface wherein the distal end comprises a first plate and the first plate comprises two through holes;

a rotating driver head disposed perpendicular to the front surface of the distal end wherein a socket can be disposed thereon and the rotating driver head can rotate in a clockwise or counterclockwise direction;

a lever mounted on the rear surface of the handle near the distal end thereof and connected to a second plate comprising a cutout that can pivot about a drag ring mounted to the cutout for selecting clockwise or counterclockwise direction of the rotating driver head;

a first rotating gear with a plurality of teeth disposed on its perimeter connected by a first shaft to the rotating driver head;

a second rotating gear mounted on a shaft on the second plate with a plurality of teeth disposed on its perimeter wherein the teeth on the first gear rotatingly mate with the teeth on the second gear; and two third gears fixed to the handle mounted laterally relative to and respectively disposed on either side of the second rotating gear wherein one of the third gears will engage the second gear when the user moves the lever to engage one of the through holes and thereby rotates the socket in the desired direction and allows the socket to turn and will disengage from the second gear to prevent the driver head from rotating in a direction not selected by the lever.

* * * * *